US007934973B2

(12) United States Patent
Trageser et al.

(10) Patent No.: US 7,934,973 B2
(45) Date of Patent: May 3, 2011

(54) PNEUMATIC ACTION FIGURE

(75) Inventors: Mark Trageser, Los Angeles, CA (US); Michael Strauss, Signal Hill, CA (US)

(73) Assignee: Mattel, Inc., El Segundo, CA (US)

( * ) Notice: Subject to any disclaimer, the term of this patent is extended or adjusted under 35 U.S.C. 154(b) by 738 days.

(21) Appl. No.: 11/422,035

(22) Filed: Jun. 2, 2006

(65) Prior Publication Data

US 2007/0004310 A1 Jan. 4, 2007

Related U.S. Application Data

(60) Provisional application No. 60/688,027, filed on Jun. 6, 2005.

(51) Int. Cl.
*A63H 33/40* (2006.01)
*A63H 13/00* (2006.01)
*A63H 13/06* (2006.01)

(52) U.S. Cl. ..... 446/199; 446/180; 446/334

(58) Field of Classification Search ..... 446/180, 446/185, 197–199, 333, 334, 336
See application file for complete search history.

(56) References Cited

U.S. PATENT DOCUMENTS

| | | | | |
|---|---|---|---|---|
| 1,605,738 | A * | 11/1926 | Idemoto | 446/198 |
| 1,859,268 | A | 5/1932 | Larson | |
| 2,131,496 | A | 9/1938 | Auger | |
| 2,570,584 | A | 10/1951 | Miskin | |
| 2,991,589 | A * | 7/1961 | Ayala | 446/192 |
| 3,089,279 | A | 5/1963 | Higgins | |
| 3,346,989 | A | 10/1967 | Ryan et al. | |
| 3,590,815 | A * | 7/1971 | Schiff | 601/153 |
| 3,599,363 | A * | 8/1971 | Baginski et al. | 446/197 |
| 3,848,357 | A | 11/1974 | Morrison | |
| 3,856,304 | A | 12/1974 | Matsumoto et al. | |
| 3,947,994 | A | 4/1976 | Meyer et al. | |
| 4,259,805 | A | 4/1981 | Horsby | |

(Continued)

FOREIGN PATENT DOCUMENTS

GB 2236686 4/1991

OTHER PUBLICATIONS

An International Search Report from International Application No. PCT/US06/21690, mailed Sep. 13, 2007.

(Continued)

*Primary Examiner* — Gene Kim
*Assistant Examiner* — Alyssa M Hylinski
(74) *Attorney, Agent, or Firm* — Kolisch Hartwell, PC

(57) ABSTRACT

A pneumatic action figure doll is disclosed with articulated limbs controlled by a hand operated pneumatic pump. The articulated limbs may comprise connected limb members and links configured to move in a plane. Operation of the hand-held pump may cause the articulated limbs to extend and retract. When the limbs are arms, operation simulates arm swinging motions similar to fighting or boxing. The doll may include actuators to extend articulated arms in response to operation of the pump. The doll may be articulated at the waist to provide movement of the torso when articulated arms extend and retract. The doll may be used alone or with other similarly configured dolls. The dolls may be placed opposite each other. Simultaneous extension and retraction of the doll arms in response to simultaneous operation of the handheld pumps may resemble fighting or boxing between the dolls.

21 Claims, 4 Drawing Sheets

U.S. PATENT DOCUMENTS

| | | | | |
|---|---|---|---|---|
| 4,367,875 | A | 1/1983 | Barlow et al. | |
| 4,529,806 | A | 7/1985 | Estreicher et al. | |
| 4,609,195 | A * | 9/1986 | Ham | 273/440.1 |
| 4,669,997 | A | 6/1987 | Kulesza et al. | |
| 4,689,033 | A | 8/1987 | Droller et al. | |
| 4,759,737 | A | 7/1988 | Ferenczi | |
| 5,042,807 | A * | 8/1991 | Sasakawa et al. | 273/440.1 |
| 5,664,983 | A * | 9/1997 | Hollis | 446/199 |
| 6,322,417 | B1 | 11/2001 | Bass | |
| 6,568,984 | B1 * | 5/2003 | Applewhite | 446/176 |
| 6,805,606 | B1 * | 10/2004 | Kellum | 446/176 |

OTHER PUBLICATIONS

International Preliminary Report on Patentability from related Application No. PCT/US2006/21690, dated Dec. 6, 2007.

* cited by examiner

PNEUMATIC ACTION FIGURE

CROSS-REFERENCES

This application claims priority to U.S. Provisional Application Ser. No. 60/688,027, filed Jun. 6, 2005 and entitled "Pneumatic Super Figure," incorporated herein by reference.

BACKGROUND

The present disclosure relates generally to action figure dolls and more particularly to action figure dolls with articulated arms or legs that may be controlled and/or driven by a user powered pneumatic pump. Examples of toys controlled by pneumatic pumps are found in the following patents and patent application publications: U.S. Pat. No. 1,605,738; U.S. Pat. No. 1,859,268; U.S. Pat. No. 2,131,496; U.S. Pat. No. 2,570,584; U.S. Pat. No. 3,089,279; U.S. Pat. No. 3,346,989; U.S. Pat. No. 3,599,363; U.S. Pat. No. 3,848,357; U.S. Pat. No. 3,856,304; U.S. Pat. No. 4,259,805; U.S. Pat. No. 4,259,806; U.S. Pat. No. 4,367,875; U.S. Pat. No. 4,609,195; U.S. Pat. No. 4,669,997; U.S. Pat. No. 4,689,033; U.S. Pat. No. 4,759,737; U.S. Pat. No. 5,042,807; U.S. Pat. No. 6,322,417 and GB2236686. The disclosures of these references are incorporated herein by reference in their entirety for all purposes.

SUMMARY

An action figure doll assembly is provided that may be used alone or with other similarly configured dolls. The action figure doll assembly may include a doll body and a hand operated pneumatic pump operably connected to the doll body. The action figure doll body may have one or more articulated limbs that allow movement, such as arms that swing. The swinging movement may simulate punches or boxing. The limbs may be controlled by the hand operated pneumatic pump.

The pneumatic pump may be of any suitable configuration, such as a piston and a cylinder, a bladder, or bellows. The pneumatic pump may pressurize air in tubes connected to an actuator located on the body of the action figure doll. The actuator may include a shaft and pressure from the pump through the tube to the actuator may extend and retract the shaft of the actuator. The actuator shaft may be connected at the shoulder to an articulated limb, such as an arm. The actuator may drive the articulated limb so the limb moves between a retracted position and an extended position. The pneumatic pump may also be configured to create a negative pressure or vacuum that acts on the actuator. The vacuum may also cause the articulated arm to move between positions.

The action figure doll may also be articulated at the waist. Movement of the doll arms may result in movement of the action figure doll upper body to further simulate punching or boxing motions.

The action figure doll may be used with other action figure dolls so two users may position their action figure dolls to face each other. The pneumatic pump and actuators of each doll may be operated simultaneously and each action figure doll may swing their arms at the other doll to simulate boxing or a fight.

The advantages of the present invention will be understood more readily after a consideration of the drawings and the Detailed Description.

DETAILED DESCRIPTION

Figure 1:
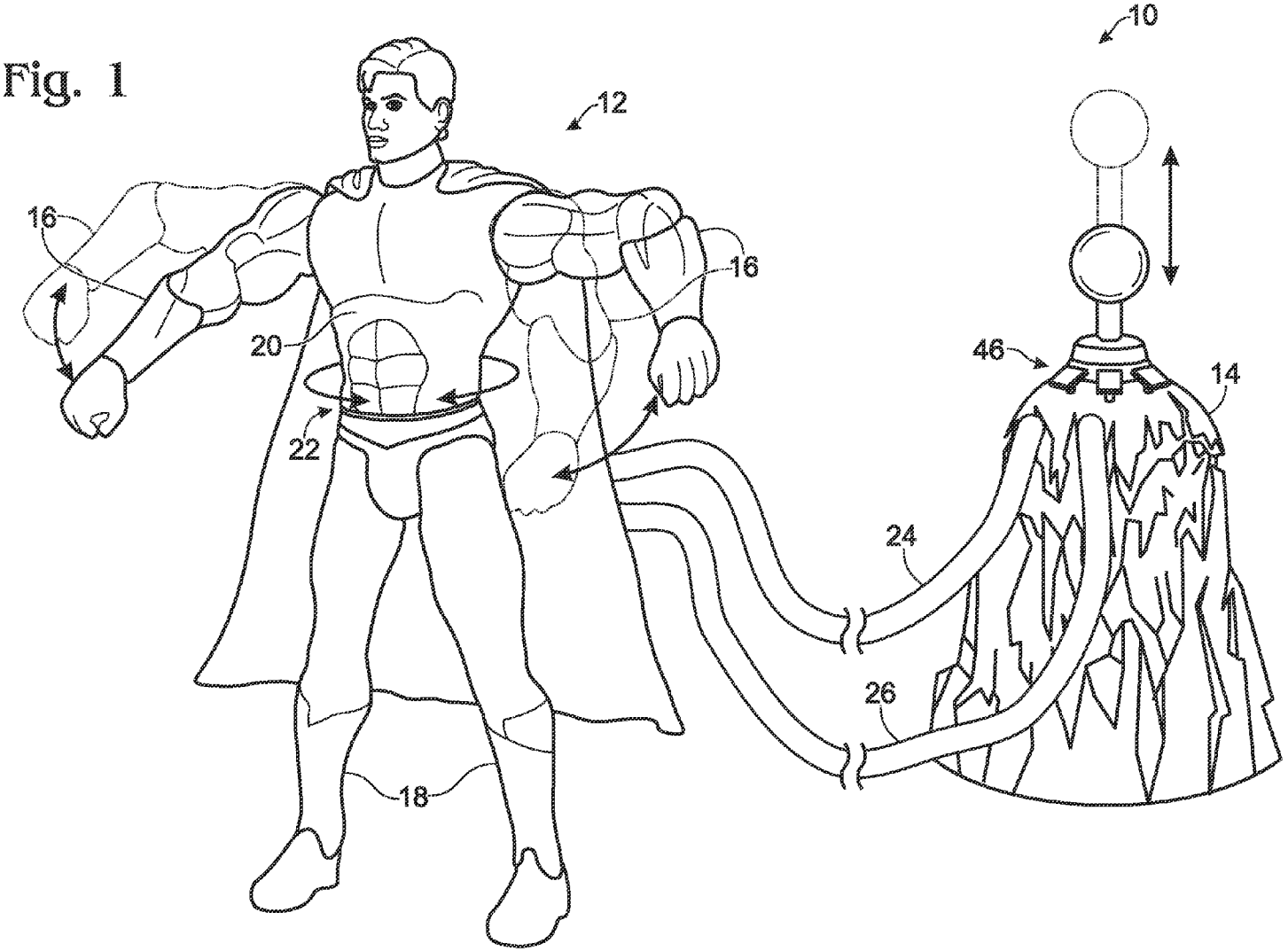
FIG. 1 is perspective view of an action figure doll assembly including a doll body and a pneumatic pump operably connected by two tubes, showing extension and retraction of the doll arms in response to operation of the pneumatic pump.

FIG. 1 shows an action figure doll assembly 10, including a doll body 12 and a pneumatic pump 14. Action figure doll body 12 may have articulated limbs. In this example, doll body 12 includes doll arms 16, doll legs 18, doll upper torso 20 and doll lower torso or waist 22. Arms 16 of doll body 12 are shown extending and retracting in response to operation of pump 14. Doll body 12 is shown with pneumatic pump 14 and right and left pneumatic tubes 24 and 26. Action figure doll body 12 may be mounted on a stand (not shown) and may have any human, animal or mechanical appearance.

Arms 16 may be articulated and may be operably connected to pneumatic pump 14. Arms 16 may move between retracted positions and extended positions as a user operates pneumatic pump 14. Moving arm 16 from retracted to extended positions and back may cause doll body 12 to simulate swinging and punching at an opponent. Body 12 may also be articulated at waist 22 between torso 20 and legs 18. Torso 20 may move in response to extension and retraction of arms 16.

Figure 7:
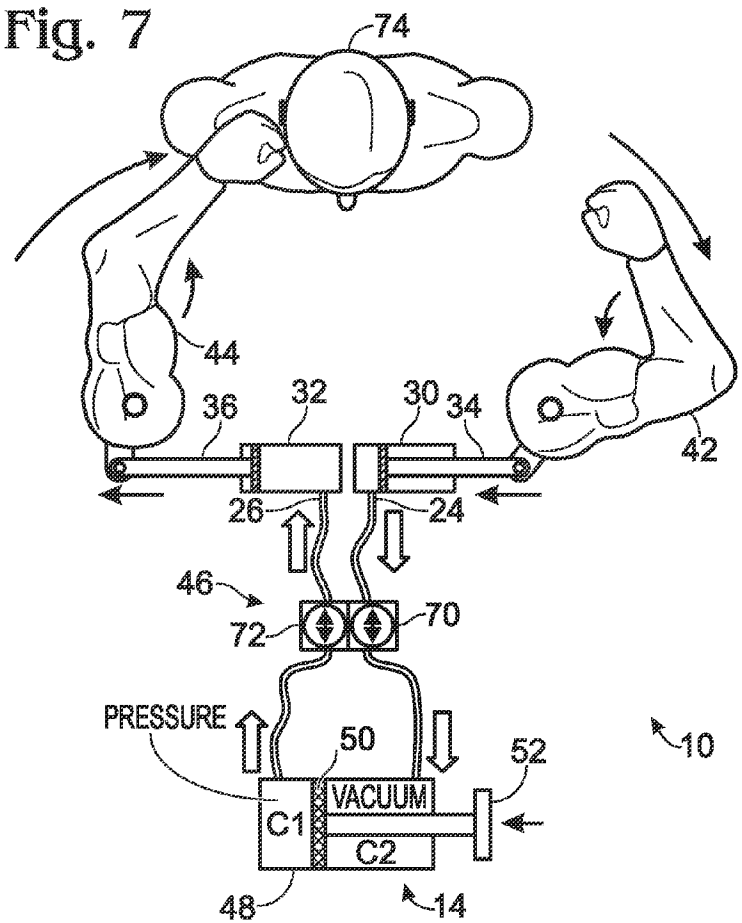
FIG. 7 is a schematic view of the action figure doll assembly, similar to FIG. 6, showing the left arm extending and the right arm retracting in response to a pump handle being pushed.
Figure 6:
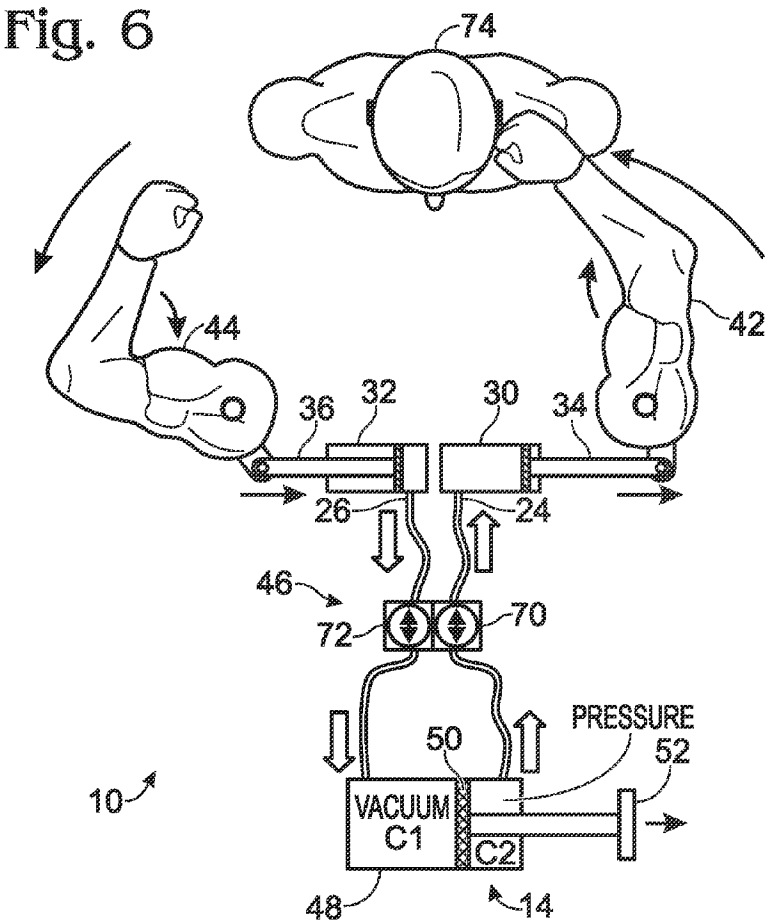
FIG. 6 is a schematic view of the action figure doll assembly of FIG. 1 showing a right arm extending and a left arm retracting in response to a pump handle being pulled.

As shown in FIGS. 6 and 7 and as described below, action figure doll assembly 10 may be used in conjunction with a second action figure doll configured to operate in a similar manner or other object. The dolls may be positioned to face one another. A fight between the doll characters may be simulated when users operate pumps 14 simultaneously and doll bodies 12 swing their arms simultaneously.

Figure 2:
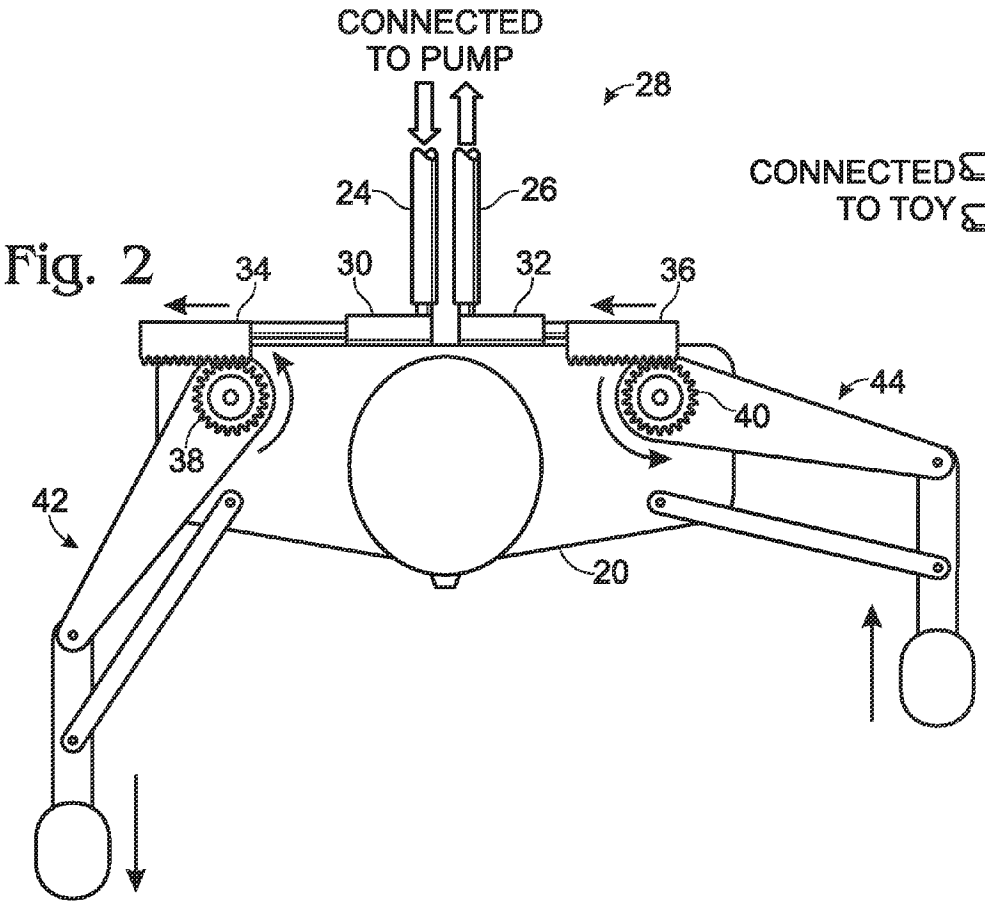
FIG. 2 is a simplified schematic view of articulated arm assemblies associated with the action figure doll of FIG. 1.

FIG. 2 is a simplified top view of a pneumatic articulated assembly 28 associated with action figure doll body 12 of FIG. 1. Articulated assembly 28 may be supported by torso 20 and includes right and left pneumatic actuators 30 and 32, right and left actuator shafts or racks 34 and 36, which may include gear teeth. Articulated assembly 28 may also include right and left pinions 38 and 40, which may engage the rack gear teeth, and right and left articulated arm assemblies 42 and 44 contained within arms 16.

Figure 3:
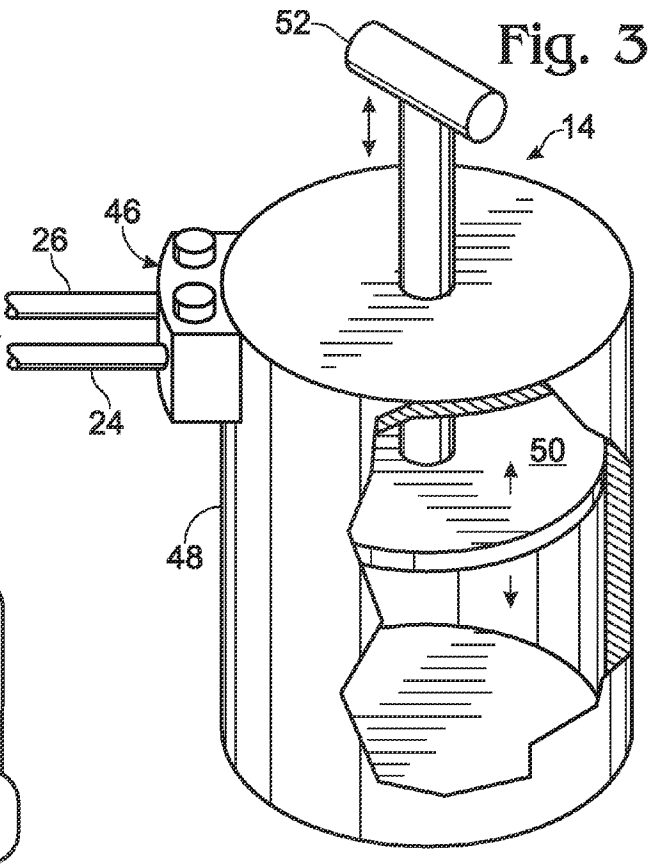
FIG. 3 is a perspective cutaway view of a pneumatic pump, similar to the pump of FIG. 1, operably connected to the articulated assembly of FIG. 2 by tubes.

Referring to FIG. 3, pneumatic pump 14 may pressurize and depressurize air. When a user operates pneumatic pump 14, air may be compressed and decompressed in tubes 24 or 26 and actuators 30 and 32. A user may select which tube is pressurized by operation of a valve assembly 46.

To simplify the explanation of doll operations, it is assumed in the following examples that the user has selected operation of tube 24, actuator 30 and arm assembly 42 at valve assembly 46. This is used as an example and not a limitation.

Compressed air in tube 24 may act on right actuator 30, which converts the pressure into linear motion of actuator rack 34. Actuator 30 may be a piston or a bellows which acts to generate transverse motion of rack 34. Rack 34 may engage pinion 38, causing it to rotate as rack 34 moves. Pinion 38 may be connected to articulated arm assembly 42, causing it to rotate.

FIG. 3 is a cutaway perspective view of pneumatic pump 14. Pneumatic pump 14 may include valve assembly 46, housing 48, piston 50 and handle 52. Pneumatic pump 14 may be operated by pushing and pulling on handle 52, displacing piston 50 and compressing air in housing 48 and/or tube 24 or 26. Tubes 24 and 26 may be operatively connected to pump 14 and valve assembly 46.

Valve assembly 46 may comprise a plurality of valves. Valve assembly 46 may operate as buttons or switches. Operating a button or switch may operate one or more valves of valve assembly 46.

Pneumatic pump 14 may operate in a plurality of modes. Pump operation modes may be selected by pressing buttons of valve assembly 46. Pump modes may determine which of tubes 24 or 26 are used. Pump modes may determine whether movement of handle 52 and piston 50 creates a vacuum or pressure in the selected tube.

Pneumatic pump 14 may be a dual action pump configured so pushing and pulling handle 52 only compresses air in selected tube 24 and/or 26. Alternatively, pneumatic pump 14 may be configured so pushing and pulling handle 52 of pump 14 compresses and decompresses air in tube 24 and/or 26. Operation of valve assembly 46 may switch pump 14 between these two modes. Optionally, movement of handle 52 in on direction may compress air tube 24 and decompress air tube 26, and movement of handle 52 in the opposite direction may decompress air tube 24 and compress air tube 26.

Figure 4:
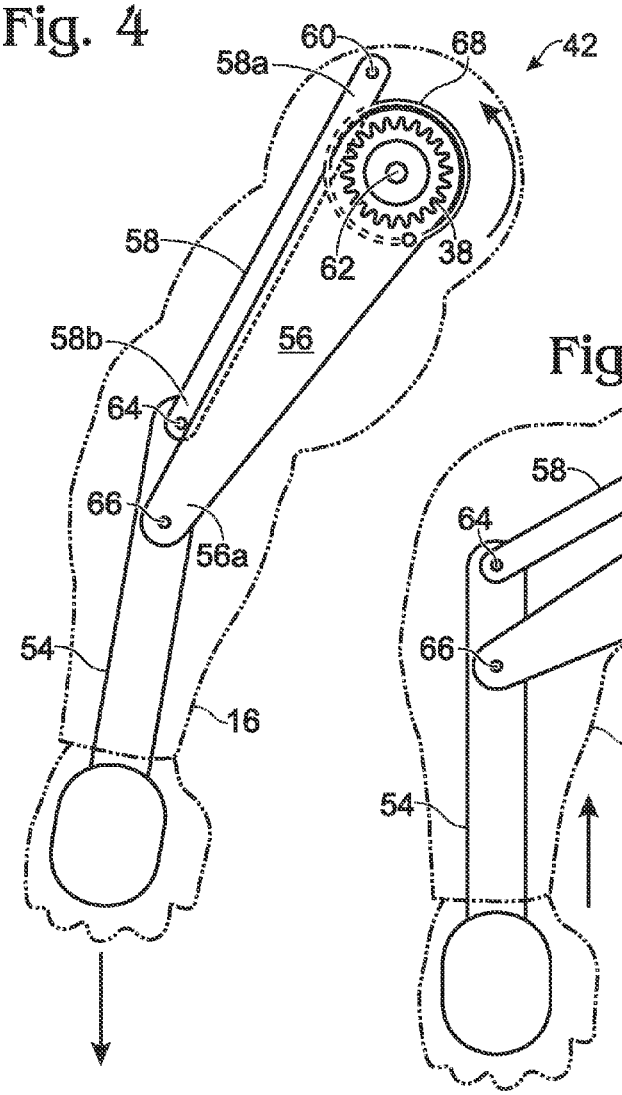
FIG. 4 is a top view of a portion of an articulated assembly of FIG. 2 showing an articulated arm in an extended position.

FIG. 4 is a top view of articulated arm assembly 42, also referred to as a limb assembly, in an extended position, including a first limb or arm member 54, a second limb or arm member 56 and a link 58. Link 58 may have a proximal end 58*a* attached to doll torso 20 at first pivot 60. Second arm member 56 may be attached to doll torso 20 at second pivot 62. First and second pivot 60 and 62 may be spaced apart but proximate. The proximal end of first arm member 54 may be connected to a distal end 56*a* of second arm 56 and distal end 58*b* of link 58 at respective spaced apart pivot connections 64 and 66. Connections 64 and 66 may also be separate but proximate on first arm 54. Second arm member 56 and link 58 may be adjacent and operatively engaged. Second arm member 56 may be fixed to pinion 38.

First and second pivots 60 and 62 may be substantially vertical such that rotation about the pivot is in a substantially horizontal plane. Second arm 56 and link 58 may remain substantially parallel when moving between retracted and extended positions. Pivots 60, 62, 64 and 66, and interconnecting sections of torso 20, first arm member 54, second arm member 56 and link 58 form a quadrilateral linkage in the form of a parallelogram.

Figure 5:
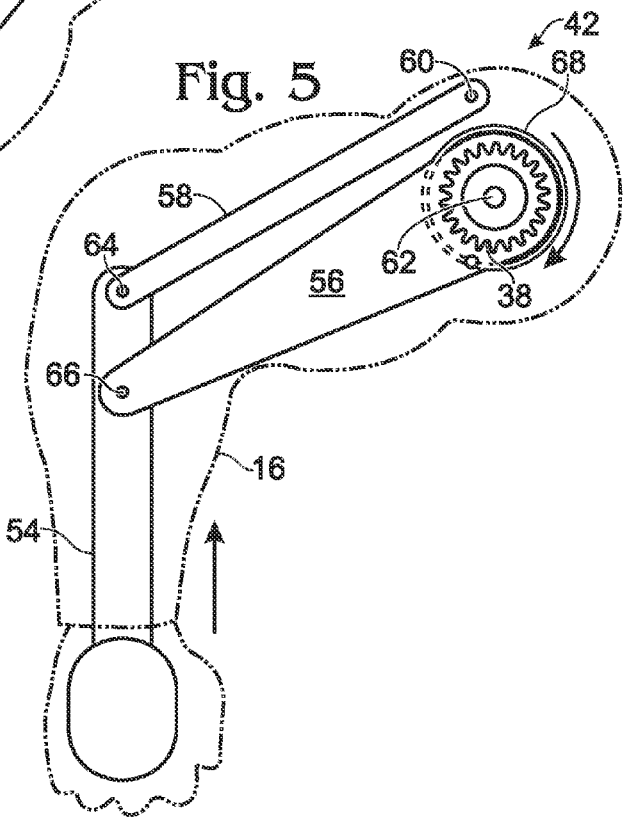
FIG. 5 is a top view of the portion of an articulated assembly of FIG. 4 showing an articulated arm in a retracted position.

FIG. 5 is a top view of articulated arm assembly 42, similar to FIG. 4, in a retracted position showing first arm 54, second arm 56 and link 58. Second arm 56 and link 58 are substantially parallel, similar to their orientation in FIG. 4. First arm 54 in FIG. 5 has a rotational orientation similar to its orientation in FIG. 4. The angle of first arm 54 in FIG. 4 is similar to FIG. 5 and no substantial rotation has occurred in moving between positions.

Operating pneumatic pump 14 may compress air in tube 24 and cause actuator rack 34 to extend or translate while engaging and rotating pinion 38. Pinion 38 may be fixed to second arm 56. Rotating pinion 38 may cause second arm 56 to rotate about pivot 62.

Articulated arm assembly 42 may be substantially enclosed by arm 16 of body 12. Operation of articulated arm assembly 42 may extend and retract arm 16, approximating movement of an arm when throwing a punch or boxing. Body 12 and arm 16 may be comprised of any material which can be formed to resemble an action figure and can flex appropriately in response to forces applied by articulated arm assembly 42. The material might be a flexible plastic. Arm 16 and body 12 may be comprised of different materials.

Articulated arm assembly 42 may be configured so full extension of arm 16 will cause articulated arm assembly 42 to automatically release and return to a retracted position. Articulated arm assembly 42 may include a spring 68, biasing second arm member 56 toward the retracted position shown in FIG. 5. Extension of arm 16 may compress spring 68. Arm 16 may be configured so extension of arm 16 may release articulated arm member 56 from pinion 38 and return the arm to a retracted position.

Alternately, on full extension rack 34 may release from pinion 38, allowing spring 68 to act and retract arm 16. In another example, spring 68 may be a component of actuator 30 and act on rack 34 to retract arm 16. In yet another example, articulated arm assembly 42 may retract in response to a lack of pressure or a vacuum in pump 14 acting on actuator 30. Other systems or configurations may be used to retract articulated arm assembly 42 and arm 16.

Referring again to FIG. 2, left articulated arm assembly 44 may operate in conjunction with left actuator 32 and left actuator rack 36 in an identical manner to right articulated arm assembly 42, right actuator 30 and right actuator rack 34. Left articulated arm assembly 44 may be configured as a reverse image of right articulated arm assembly 42 with all components and configurations reversed right to left to operate as the left arm 16 of doll 10.

As discussed previously, operation of valve assembly 46 may select from a plurality of modes of operation of doll assembly 10. Action figure doll assembly 10 may be configured so that pushing on handle 52 of pump 14 may cause articulated arm assembly 42 to extend and simultaneously cause articulated arm assembly 44 to retract. Pulling on handle 52 may cause articulated arm assembly 42 to retract and simultaneously cause articulated arm assembly 44 to extend. Pushing and pulling handle 52 may simulate sequential left and right punches by action figure doll assembly 10 that are repeated until pushing and pulling of handle 52 stops. Changing modes using valve assembly 46 may subsequently cause only left arm assembly 44, or only right arm assembly 42 to extend and retract as handle 52 is pushed and pulled.

FIGS. 6 and 7 are schematic representations of one example of the functions of action figure doll assembly 10, showing pump 14, including housing 48, piston 50 and handle 52, tubes 24 and 26, right actuator 30, left actuator 32, right articulated arm assembly 42, left articulated arm assembly 44, valve assembly 46, including right valve 70 and left valve 72, and an opponent 74. Opponent 74 may be a similarly configured action figure doll assembly 10.

In this example, pump 14 has a chamber C1 below piston 50 and a chamber C2 above piston 50. As handle 52 is pushed, pressure is created in chamber C1 and a vacuum is created in chamber C2. As handle 52 is pulled, pressure is created in chamber C2 and a vacuum is created in chamber C1. Tube 24 is operably connected to chamber C2 and tube 26 is operably connected to chamber C1.

This is an example for illustration of the doll's functionality and should not be construed as a limitation. Valve assembly 46 may have more or fewer valves than shown in this example, or configurations may be different than those shown. Articulated arms 42 and 44 are not shown in detail.

Valves 70 and 72 of valve assembly 46 may select which of tubes 24 and 26 operably connect to pump 14. In FIG. 6, right valve 70 and left valve 72 are both open, operably connecting both tubes 24 and 26 to pump 14. When handle 52 is pulled, pressure increases in chamber C2, tube 24 and actuator 30, causing articulated arm assembly 42 to extend and swing at opponent 74. Simultaneously, pressure in chamber C1, tube 26 and actuator 32 is reduced, retracting left articulated arm assembly 44.

Pushing handle 52 as shown in FIG. 7, again with valves 70 and 72 open, increases pressure in chamber C1, tube 26 and actuator 32 causing left articulated arm assembly 44 to extend, hitting opponent 74. Simultaneously, pressure is reduced in chamber C2, tube 24 and actuator 30, causing right articulated arm assembly 42 to retract. Pushing and pulling handle 52 with valves 70 and 72 open may cause both arms 16 to alternately extend and retract, simulating boxing or fighting.

Operating pump 14 with valve 72 closed and valve 70 open may cause left articulated arm assembly 44 to remain in a retracted position as handle 52 is pushed and pulled, and may cause right articulated arm assembly 42 to extend and retract. Similarly, operating pump 14 with valve 70 closed and valve 72 open may cause right articulated arm assembly 42 to remain in a retracted position as handle 52 is pushed as pulled, and left articulated arm assembly 44 to extend and retract.

Right and left articulated arm assemblies 42 and 44 may be biased by a spring, as discussed previously, to maintain the assemblies in a retracted position while not connected to pump 14. Valves 70 or 72 in a closed position may maintain tubes 24 or 26 at a neutral pressure.

Figure 8:
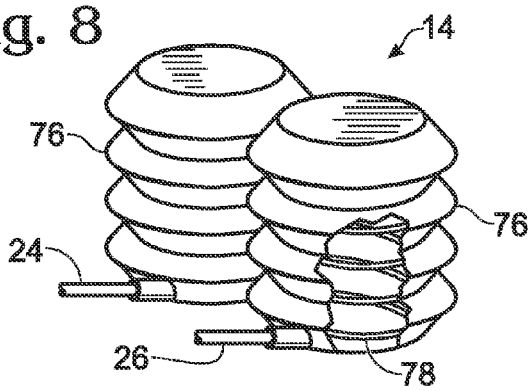
FIG. 8 is a perspective of a pair of bellows type pneumatic pumps, with a cutaway of one of the bellows pumps showing an internal spring.

In an alternate configuration, pneumatic pump 14 may be a pair of user operated bellows 76. FIG. 8 is a cutaway view of bellows 76 in an extended position, showing a spring 78 internal to bellows 76. Bellows 76 may have a first extended or expanded position with spring 78 uncompressed. Operation of bellows 76 may include compressing bellows 76 to a second position which compresses spring 78. Releasing bellows 76 may allow spring 78 to act on bellows 76, causing it to return to the extended or expanded position.

Compressing bellows 76 may pressurize air in tube 24 or 26 and cause arm assemblies 42 or 44 to extend.

These are examples only and should not be construed as limitations. Other configurations could be implemented and still be within the scope of this disclosure. Articulated assemblies may have pivots, links and arms in different positions. A fluid other than air may be pressurized by pump 14 and act on actuators 30 and 32. Doll body 12 may depict a different action figure. Components depicted as pistons may be implemented as bellows. Additional modes or combinations of actions and effects may be contemplated and fall within the scope of this disclosure.

It is believed that the disclosure set forth above encompasses multiple distinct inventions with independent utility. While each of these inventions has been disclosed in its preferred form, the specific embodiments thereof as disclosed and illustrated herein are not to be considered in a limiting sense as numerous variations are possible. The subject matter of the inventions includes all novel and non-obvious combinations and subcombinations of the various elements, features, functions and/or properties disclosed herein.

Inventions embodied in various combinations and subcombinations of features, functions, elements, and/or properties may be claimed through presentation of claims in a related application. Such claims, whether they are directed to a different invention or directed to the same invention, whether different, broader, narrower or equal in scope, are also regarded as included within the subject matter of the present disclosure.

We claim:

1. A toy doll assembly comprising:

first and second articulated limbs supported on a torso, each being movable between extended and retracted positions with respect to the torso;

first and second actuators each operably coupled with, and separately actuable to move, a corresponding one of the first and second articulated limbs;

a pump having a single pump handle, and first and second chambers separated by a movable piston, wherein the piston is configured to move responsive to operation of the pump handle to thereby reciprocally pressurize and depressurize each of the first and second chambers; and a valve assembly configured to select whether the first, the second, or both of the first and second pneumatic actuators are actuated by operation of the pump, the valve assembly including first and second valves, the first valve being configured to be moved between an open position in which the first pneumatic actuator is pressurized and depressurized by the first chamber, and a closed position in which the first pneumatic actuator is not pressurized and depressurized by the first chamber, the second valve being configured to be moved between an open position in which the second pneumatic actuator is pressurized and depressurized by the second chamber, and a closed position in which the second pneumatic actuator is not pressurized and depressurized by the second chamber.

2. The toy doll assembly of claim 1, wherein the articulated limbs are pivotably supported on the torso.

3. The toy doll assembly of claim 1, wherein each of the articulated limbs is configured to move in a substantially horizontal plane between extended and retracted positions.

4. The toy doll assembly of claim 1, wherein the planes in which each of the articulated limbs move are transverse to each other.

5. The toy doll assembly of claim 1, wherein the valve assembly is interposed between the pump and the pneumatic actuators.

6. The toy doll assembly of claim 1, wherein the first and second chambers correspond with the first and second actuators, respectively, and the articulated limb corresponding to each selected actuator moves to the extended position upon pressurization of the corresponding chamber.

7. The toy doll assembly of claim 6, wherein the articulated limb corresponding to each selected actuator moves to the retracted position upon depressurization of the corresponding chamber.

8. The toy doll assembly of claim 6, wherein one or more of the pneumatic actuators includes a rack, and wherein a corresponding one or more of the articulated limbs includes a pinion positioned for selective engagement of the rack, such that actuation of the one or more actuators engages the corresponding pinion, thereby moving the corresponding articulated limb to the extended position.

9. The toy doll assembly of claim 8, wherein the one or more racks are configured to release from the corresponding one or more pinions upon movement of the articulated limb to the extended position.

10. The toy doll assembly of claim 9, wherein the one or more articulated limbs are biased toward the retracted position, and return to the retracted position upon release of the rack from the corresponding pinion.

11. The toy doll assembly of claim 6, wherein one or more of the articulated limbs are biased toward the retracted position, and return to the retracted position automatically upon movement of the articulated limb to the extended position.

12. The toy doll assembly of claim 1, wherein the pump includes a pump housing from which the handle extends, and wherein the pump handle is operated by alternately pushing the handle toward, and pulling the handle away from, the pump housing.

13. The toy doll assembly of claim 12, wherein the pump housing houses the first and second chambers.

14. The toy doll assembly of claim 12, wherein pushing the pump handle toward the pump housing fully pressurizes one of the first and second chambers, and simultaneously fully depressurizes the other of the first and second chambers.

15. A toy doll assembly comprising:

first and second articulated limbs supported on a torso, each being movable between extended and retracted positions with respect to the torso;

first and second pneumatic actuators each operably coupled with, and separately actuable to move, a corresponding one of the first and second articulated limbs;

a pump assembly including:

a pump;

a single pump handle movable between two handle positions relative to the pump; and first and second tubes providing fluid communication between the pump and the first and second actuators, respectively;

wherein the pump is operated by moving the pump handle from one handle position to the other to pressurize one or more of the tubes; and a valve assembly interposed between the pump assembly and the pneumatic actuators and configured to operate the pump in one of a plurality of modes in which the first, the second, or both of the first and second tubes are pressurized by operation of the pump, the valve assembly including first and second valves, the first valve being configured to be moved between an open position in which the first pneumatic actuator is pressurized and depressurized by the pump, and a closed position in which the first pneumatic actuator is not pressurized and depressurized by the pump, the second valve being configured to be moved between an open position in which the second pneumatic actuator is pressurized and depressurized by the pump, and a closed position in which the second pneumatic actuator is not pressurized and depressurized by the pump.

16. The toy doll assembly of claim 15, wherein the articulated limbs are pivotably supported on the torso.

17. The toy doll assembly of claim 15, wherein each of the articulated limbs is configured to move in a substantially horizontal plane between extended and retracted positions.

18. The toy doll assembly of claim 15, wherein in one mode of pump operation, operation of the pump by moving the pump handle from one handle position to the other, and back again, pressurizes only a selected one of the first and second tubes.

19. The toy doll assembly of claim 15, wherein in one mode of pump operation, operation of the pump alternately pressurizes and depressurizes a selected one of the first and second tubes.

20. The toy doll assembly of claim 15, wherein in one mode of pump operation, operation of the pump by moving the pump handle from one handle position to the other, and back again, only pressurizes both of the first and second tubes.

21. The toy doll assembly of claim 1, wherein the valve assembly further includes a first button configured to move the first valve between its open and closed positions, and a second button configured to move the second valve between its open and closed positions.

* * * * *